US006335694B1

(12) United States Patent
Beksa et al.

(10) Patent No.: US 6,335,694 B1
(45) Date of Patent: Jan. 1, 2002

(54) AIRBORNE AUDIO FLIGHT INFORMATION SYSTEM

(75) Inventors: John Beksa, Laguna Hills; Shawn Kathol, Diamond Bar, both of CA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/496,157

(22) Filed: Feb. 1, 2000

(51) Int. Cl.[7] ..... G08B 21/00

(52) U.S. Cl. ..... 340/945; 340/951; 340/952; 340/971; 348/62; 348/117; 434/112

(58) Field of Search ..... 340/945, 951, 340/952, 971; 348/62, 117; 434/112

(56) References Cited

U.S. PATENT DOCUMENTS

| | | | | | |
|---|---|---|---|---|---|
| 4,975,696 | A | * | 12/1990 | Salter, Jr. et al. | 340/973 |
| 5,208,590 | A | | 5/1993 | Pitts | 340/973 |
| 5,714,948 | A | * | 2/1998 | Farmakis et al. | 340/961 |
| 5,798,458 | A | * | 8/1998 | Monroe | 73/587 |
| 5,896,129 | A | * | 4/1999 | Murphy et al. | 345/327 |
| 5,973,722 | A | * | 10/1999 | Wakai et al. | 348/8 |
| 6,003,009 | A | * | 12/1999 | Nishimurra | 705/5 |

* cited by examiner

*Primary Examiner*—Daniel J. Wu
*Assistant Examiner*—Tai T. Nguyen
(74) *Attorney, Agent, or Firm*—Nathan O. Jensen; Kyle Eppele

(57) ABSTRACT

An audio system that may include a flight-worthy electronics package that connects into the airborne electronics of a passenger aircraft, and to that aircraft's passenger system. The audio system may provide passengers with a variety of audio information. The audio information may include a variety of information tailored to phases of the flight plan of the aircraft. Thus, during takeoff, the system may describe the flight plan of the aircraft, whereas during descent, the system may alternately describe the distance to destination and time to destination. Other information that may be described, as desired, may include ground speed, outside air temperature, altitude, time or distance to a point of interest, and points of interest of the area that the aircraft is flying over at any particular moment. The audio system may cause these sequences of descriptions to recite automatically as determined by the preprogramming of the system. Passengers may also be provided with audio destination information. The audio system may describe the terminals and the aircraft gates. The audio system may also identify the gate at which the aircraft will be arriving, connecting flight information, including describing flight numbers, times, gates, and destination.

23 Claims, 3 Drawing Sheets

AIRBORNE AUDIO FLIGHT INFORMATION SYSTEM

BACKGROUND OF THE INVENTION

The instant invention relates generally to improvements in aircraft passenger information systems. More particularly, the instant invention pertains to a new and improved audio system for utilization in the passenger compartment of an aircraft. The instant invention provides instructive and entertaining audio information to an aircraft passenger.

DESCRIPTION OF THE PRIOR ART

Display systems relating to aircraft abound in the prior art. Such systems are utilized for a variety of purposes. Some purposes include tracking and analyzing information relating to air traffic control, displaying information on flights to provide for advanced planning and scheduling, and monitoring ground traffic at an airport. However, such systems are typically used for the administering of aircraft traffic, not for aircraft passengers.

As to aircraft passengers, U.S. Pat. No. 4,975,696, to Salter, Jr., et al., and U.S. Pat. No. 5,208,590 to Pitts, teach some visual display solutions of providing visual information to aircraft passengers. Both of these patents are incorporated by reference as though fully set forth herein.

U.S. Pat. No. 4,975,696 teaches a visual display electronics package connecting the airborne electronics of a passenger aircraft to the passenger visual display system of the aircraft. The visual display electronics package provides passengers with a variety of real-time visual displays of information, such as ground speed, outside air temperature, or altitude. Other visually displayed information by the visual display electronics package includes a map of the area over which the aircraft flies, and destination information. This visual display information includes graphical items such as a chart of the destination terminal including aircraft gates and connecting flight information listings.

Although the visual display electronics package of U.S. Pat. No. 4,975,696 may provide useful information to passengers in an aircraft, it does not automatically tailor such information to the phases of flight of the aircraft.

U.S. Pat. No. 5,208,590 teaches one solution to automatically provide visual display flight information, utilizing a predetermined sequence of visual display information corresponding to various phases of the flight plan of the aircraft.

However, neither of these patents address the serious problem of, e.g., sightless persons, or sight challenged persons, and their flight information needs. Nor does either of these patents address the problems resulting when the passengers would rather not look at a visual display. Nor does the conventional art provide solutions for the passengers, for example, that do not wish to disturb adjoining passengers, e.g., at night, by looking at a lighted visual display.

Further un-accommodated are the needs of any passenger, e.g., that might wish to look out the window and observe the points of interest, rather that having to study the points of interest on a visual display. Also not accommodated are the passengers that would, e.g., prefer to read, rather than having to study the visual display to know when a point of interest is coming up.

Accordingly, it is an object of the instant invention to provide a device and method for providing an approximately real-time flight information audio system for aircraft passengers that describes useful information to aircraft passengers en route to their destination.

Another object of the instant invention is to provide a device and method for providing a flight information audio system for aircraft passengers that connects into the present passenger information system of the aircraft.

Another object of the instant invention is to provide a device and method for providing a flight information audio system for the aircraft passenger wherein the system describes flight information. The flight information may include, for example, ground speed, distance or time to destination or to points of interest, approximately real-time description of points of interest, flight plan, and outside air temperature.

Yet another object of the instant invention is to provide a device and method for providing an audio system for the aircraft passenger that describes a predetermined sequence of flight information corresponding to each phase of the flight plan of the aircraft.

Another object of the instant invention is to provide a device and method for providing an audio system for aircraft passengers that describes the terminal at which the aircraft is to land. The audio system may also include additional useful information such as the arrival gate, baggage claim area, and other gate locations in the terminal.

Yet another object of the instant invention is to provide a device and method for providing an aircraft passenger audio system wherein the system describes, for example, connecting gate information. The connecting gate information may include departure gates, times of departure, destinations, and flight numbers.

Another object of the instant invention is to provide a device and method for providing an aircraft passenger audio system wherein the system may provide, for example, audio advertising content delivered to the passenger.

Finally, an object of the present invention is to provide a solution for at least some of these aforementioned problems.

SUMMARY OF THE INVENTION

The full scope of the instant invention is best understood by examining the detailed description and appended claims with reference to the drawings. However, a brief summary of the invention follows.

Briefly described, the instant invention comprises a device and a method that provides for an audio flight information system. The audio system may include a flight-worthy electronics package that connects into the airborne electronics of a passenger aircraft, and to that aircraft's passenger system. The audio system may provide passengers with a variety of audio information.

The audio information may include a variety of information tailored to phases of the flight plan of the aircraft. Thus, during takeoff, the system may describe the flight plan of the aircraft, whereas during descent, the system may describe the distance to destination and time to destination. Other information that may be described, as desired, may include ground speed, outside air temperature, altitude, time or distance to a point of interest, and points of interest of the area that the aircraft is flying over at any particular moment. The audio system may cause these sequences of descriptions to recite automatically as determined by the preprogramming of the system.

Passengers may also be provided with audio destination information. The audio system may describe the terminals and the aircraft gates. The audio system may also identify the gate at which the aircraft will be arriving, connecting flight information, including describing flight numbers, times, gates, and destination.

Also, passengers may be provided with audio advertising content. For example, before or after an audio description of a point of interest, an advertising clip or segment may be provided.

BRIEF DESCRIPTION OF THE DRAWINGS

The invention is described in detail herein with reference to the drawings in which.

The accompanying drawings, wherein like numerals denote like elements, are incorporated into and constitute a part of the specification, and illustrate presently preferred exemplary embodiments of the invention. The drawings, together with the general description given above, and in the detailed description of the preferred embodiments given below, serve to explain the principles of the invention.

DETAILED DESCRIPTION OF THE PREFERRED EMBODIMENT

Figure 1:
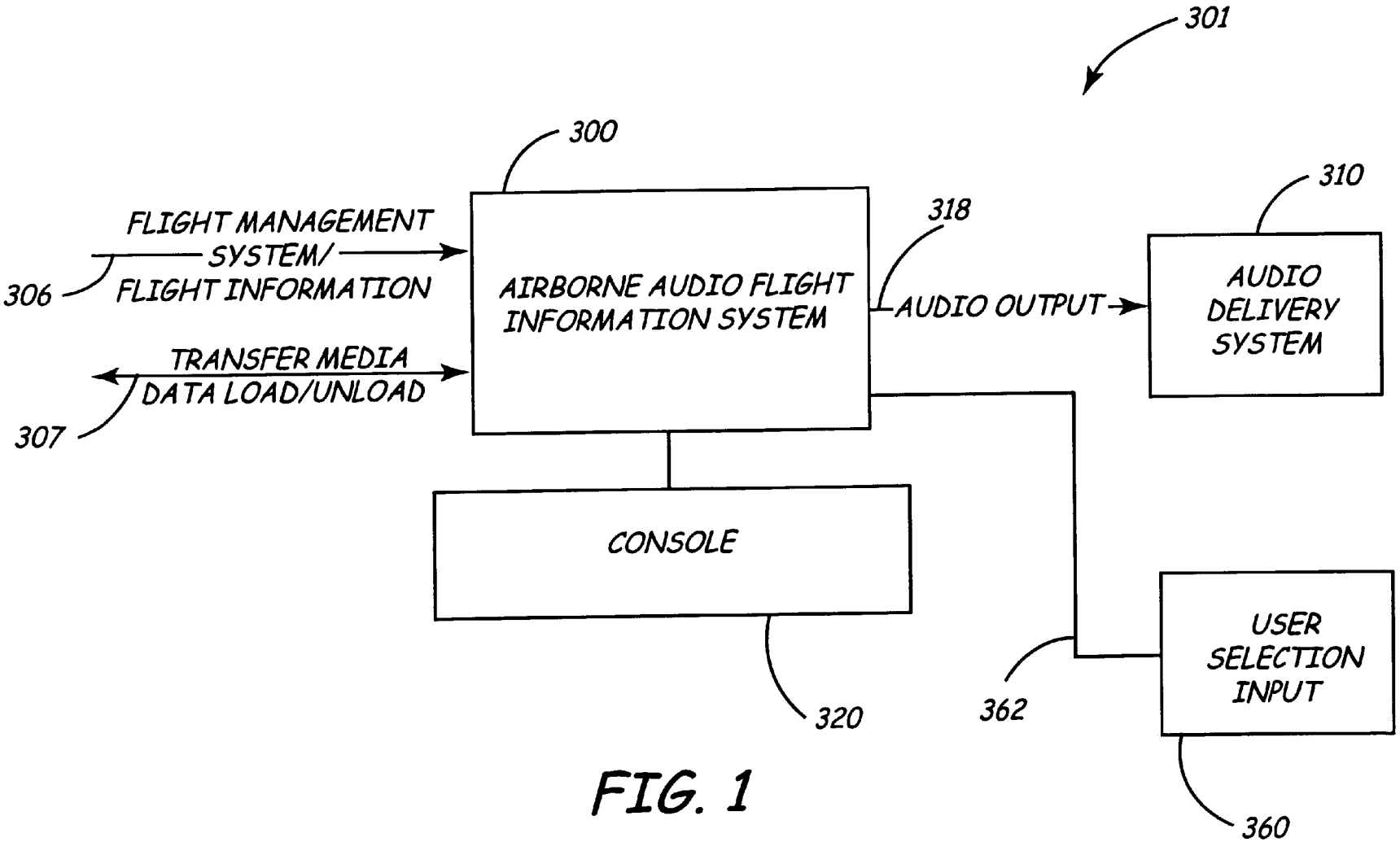
FIG. 1 illustrates a block diagram of an airborne audio flight information system of the present invention.
Figure 2:
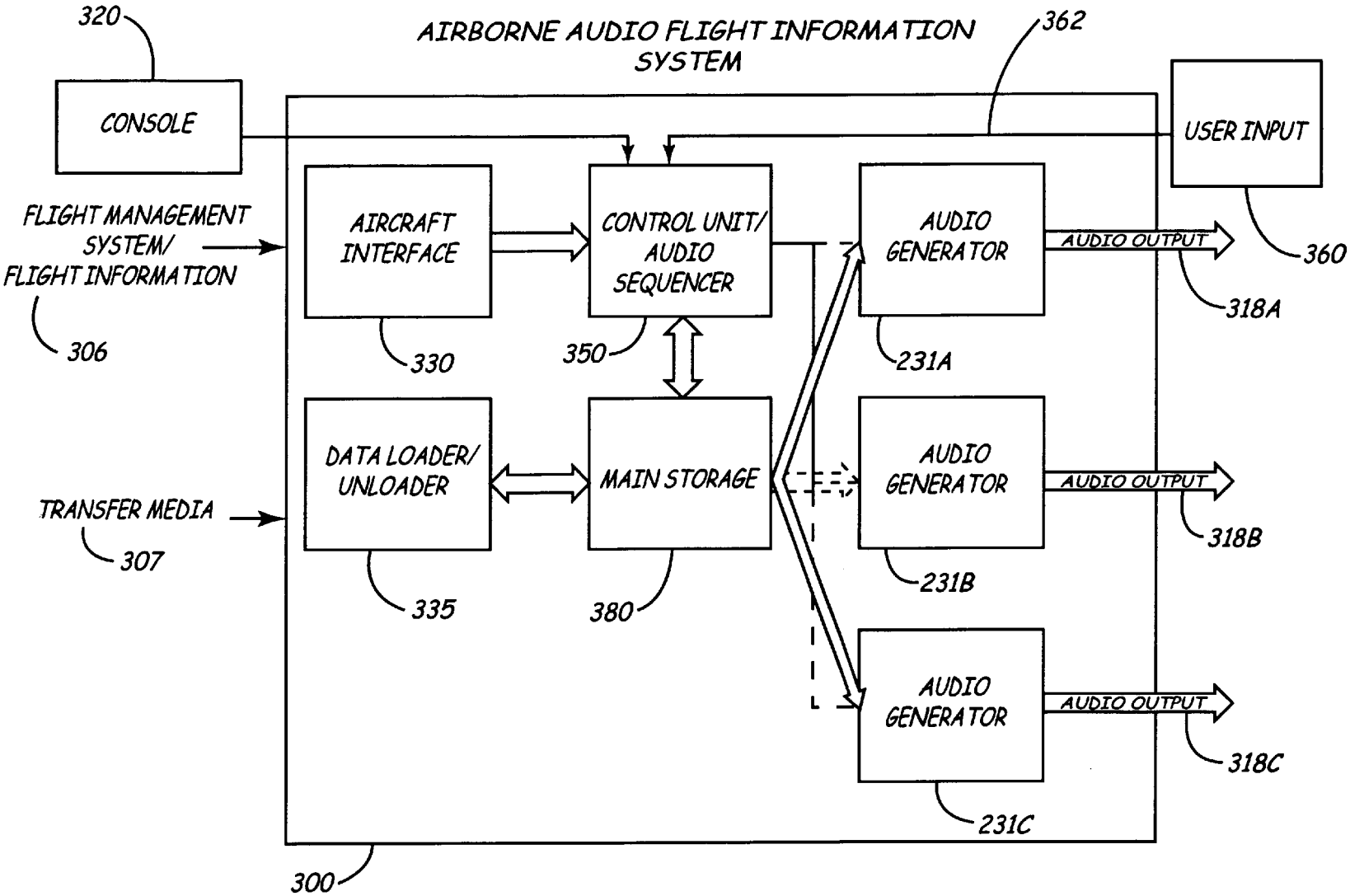
FIG. 2 illustrates a block diagram of the airborne audio flight information generator of the present invention.
Figure 3:
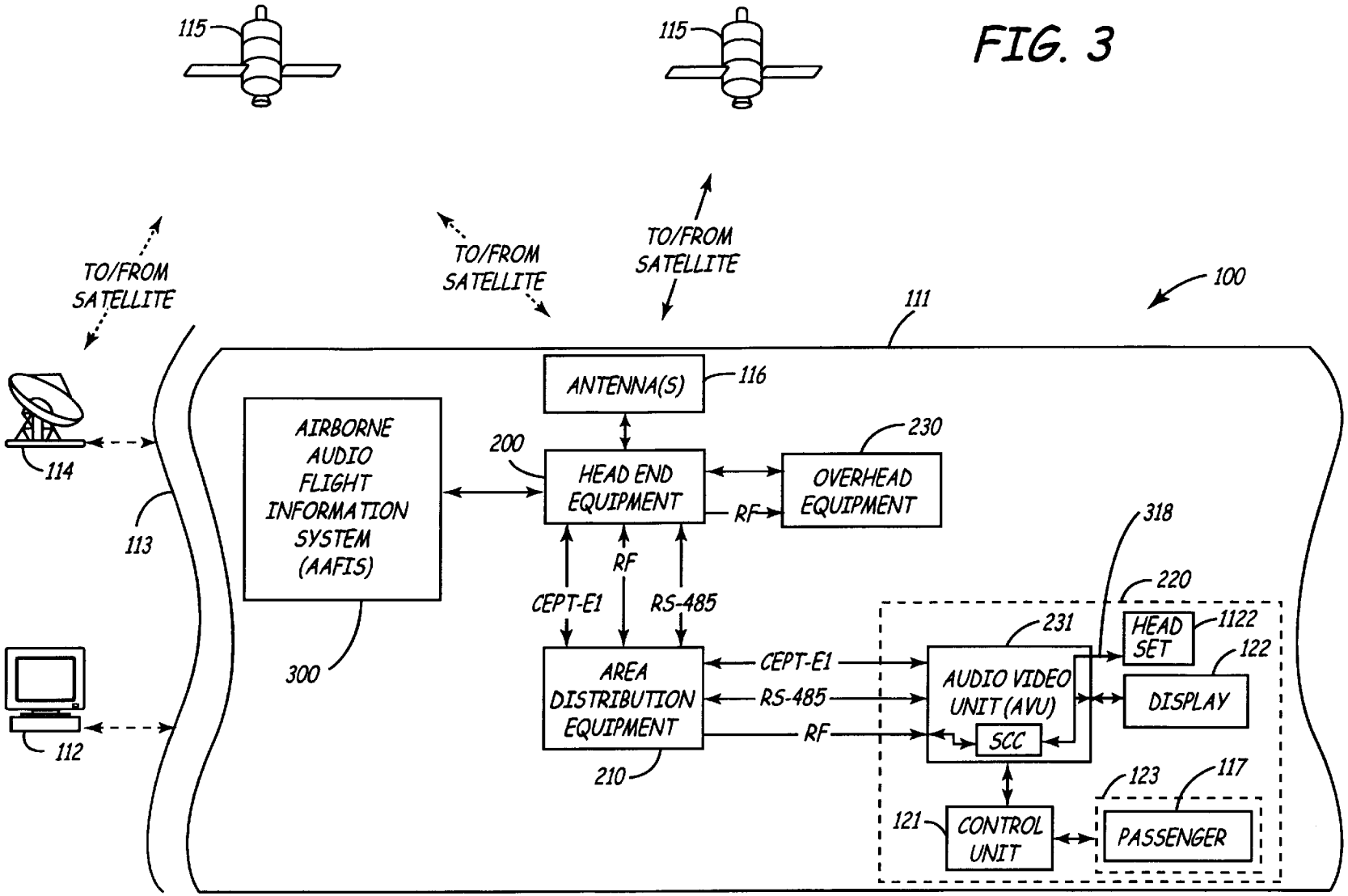
FIG. 3 illustrates a block diagram of another airborne audio flight information system of the present invention.

The instant invention is illustrated utilizing an audio flight information device. FIGS. 1–3 illustrate various techniques and alternatives in the practice of the current invention. In the following description, the same reference numerals are utilized for substantially similar elements in FIGS. 1–3, for the purpose of clarity. However, it will be apparent to one skilled in the art, for example, that some of the "like" elements may not actually need to be substantially similar or identical in order to practice the invention. Also, embodiments of the invention, as one skilled in the art recognizes, may be practiced on devices with these variations, and differences, as well as on other alternate embodiments, and all are within the scope of this description and the appended claims.

Further, some of the bus and signal lines utilized in the practice of certain arrangements of the instant invention are shown in FIGS. 1–3. However, it will be understood by one skilled in the art that generally the electrical circuit paths, traces, terminals, and electrical components, and respective software components, that may comprise at least portions of the various arrangements of the instant invention as illustrated in FIGS. 1–3, are not shown, in order to simplify the illustrations.

FIG. 1 illustrates an arrangement of a device in the practice of the instant invention, namely an audio flight information device, or system 300. FIG. 1 illustrates one arrangement of an audio on-board system 301 for providing audio information to an aircraft passenger. The audio information system 300 receives, e.g., flight information and other information data via a flight management system signal line 306 and a transfer media bi-directional signal line 307, from various aircraft systems. Examples of these various aircraft systems may include a flight navigation system, aircraft air data system, a central maintenance computer, an ACARS/AIRCOM/SITA communication network receiver, and a receiver utilizing various conventional information and communication systems via ground, airborne or satellite link. The audio information system 300 may be connected to any one or a multiple of these input sources, or other sources of audio data, depending upon the type of audio information desired to be provided to a passenger of the aircraft.

After processing the received information data, the audio information system 300 transmits an audio data signal over the audio output signal line 318 to an audio delivery system 310. The audio delivery system 310 may then route an audio signal to a plurality of passengers.

Although not shown, in another arrangement, the aircraft audio on-board system 301 may be placed within the context of an airborne communication link between the aircraft and a remote transmitter located on the ground. Some examples of this type of communication link are more fully described in the above referenced U.S. Pat. Nos. 4,975,696 and 5,208,590. Of course, other conventional communication links, including airborne or space based links, may also be utilized. The information data may be transmitted to an aircraft receiver and then supplied to the audio information system 300.

Some examples of information data that may be gathered via these communication links include connecting flight information and terminal and gate information. Also, the information data may include data that a specific airline's remote station may transmit to its own aircraft.

The link from the remote transmitter to the on-board system 301 may comprise a part of the ACARS/AIRCOM/SITA communication network. In this arrangement, an aircraft receiver may provide information data directly into the audio information system 300. Another arrangement may comprise inputting the information data via an optional data entry terminal, or console 320, that may be directly connected to the audio information system 300. The console 320 may, e.g., comprise any one, or a combination, of a computer keyboard, an electronic keypad entry device, a paper punch data entry device, a computer terminal, a touch screen, and an optical scanner.

In yet another alternate arrangement, a feed back signal, or user selection input device 360, may be connected to the audio information system 300, so as to provide user request signals along a user input signal line 362. Users may comprise, e.g., a flight crew member or a passenger.

The user selection input device 360 may be utilized, e.g., to select various channels or venues of audio output. For example, the user may choose a channel that may comprise destination information, or another channel that may provide various information related to the phases of flight, such as points of interest within visual sight of the aircraft. In this example, the user may now look out the window and view the point of interest, while simultaneously listening to the audio description of the point of interest. Alternately, the user may, e.g., listen for when a point of interest is near, and thereby avoid having to study a visual display and thus interrupt the passenger's reading or other activities. This audio system arrangement may also provide information in an improved manner as compared to a visual display, for the passenger that is sight impaired.

Alternately, the user may, e.g., designate one portion of the aircraft to receive a first channel, and a second portion to receive a second channel, and deny a third portion from receiving any audio information channels. Each of these channels may be interspersed with audio output comprising the specific airline's messages or information, or general advertising.

Referring to FIG. 2, a more detailed illustration of one arrangement of the audio information system 300 is illustrated. The audio information system 300 may comprise a control unit 350, one or more audio generators 231A–C, a main storage or memory device 390, an aircraft interface 330, and a data loader/unloader 335.

The audio information control unit 350 may comprise, e.g. an audio sequencer, and may also comprise a microprocessor, if desired. The control unit 350 receives information data from the above described input sources, preferably through the aircraft interface 330. The control unit 350 manipulates the received information data and transmits the data to the audio generators 231A–C. In response to the received information and/or an input from console 320 and/or a user input 360, control unit 350 communicates with a main storage, or memory device, 390. If desired, the memory device 390 may contain audio segments that may be assembled into audio descriptions for each of the airport terminals that the particular aircraft may be flying in and out of. Control unit 350 processes the received data to generate an audio description, or audio signal, according to software utilized with the microprocessor.

The resulting data signal may then be submitted by control unit 350 to audio signal generators 231A–C. The audio signal generator processes the output data signal into a audio signal that may drive, e.g., a passenger headphone set. If desired, the control unit 350 may also accept user input control signals along signal line 362 from the user input device 360.

As to the received information data, the audio information system 300 may utilize, e.g., a fixed format information data. The audio information control unit 350 may then, e.g., treat the up-linked data as two functionally separate sub-blocks, that may be characterized as a header and free-text. An example of header and free text type of input data is more fully described in the above referenced U.S. Pat. Nos. 4,975,696 and 5,208,590.

For example, the fixed header format may be separated from the remaining data, the remaining data comprising free-text. In one arrangement, the audio information control unit 350 does not substantially alter the free text. Instead, the audio information control unit 350 utilizes a voice synthesizer processor device to provide an audio signal representative of the free text substantially as it is received. An example of text that may not be synthesized includes the end statement. The end statement may instead be utilized as a stop indicator to the control unit 350. The control unit 350 may then insert other segments of stored audio segments or other information data, e.g., audio advertisements, or audio descriptions relating to the phases of flight.

The fixed header may also contain strings of characters that may be utilized by the audio information control unit 350 to synthesize or generate an audio output. For example, four strings that may be utilized include the flight number string, the destination airport string, the arrival gate string and the baggage claim area string. Once the strings are extracted and identified, the audio generation process may be performed in a similar manner to the audio signal generation of the free text.

In one technique, the audio information control unit 350 may utilize conventional processor devices and methods to synthesize an audio signal from the free text. In an alternative technique, the control unit 350 may select one or more audio segments, e.g. by utilizing a lookup table. Of course, a combination of both of these techniques may also be utilized to generate the audio output.

Just one example of the various techniques that may be utilized by the audio information system 300 to process the received information data is now described.

Whenever there is information data to be received, the audio information control unit 350 may interrupt any current task[s] to read the new data.

The control unit 350 then reads information data from the input signal lines until a completed or end of message indication is received.

After receiving an end of message, any specific information, e.g., connecting gate information such as the destination airport, arrival gate and baggage claim area, may be extracted from the header. The extracted connecting gate information may then be synthesized into, or utilized to generate, an audio description. Generally, a pre-stored message may be stored in memory 390. One example of a pre-stored message is: "The baggage claim area is number _" where the blank portion, or space, may be filled in, or updated, during the flight. For example, the number "2" may be inserted in the space at the end of the message, so that the full message of "The baggage claim area is number 2" may be heard by the passengers.

In various arrangements of the instant invention, the main storage 390 may comprise a solid state memory, and/or a magnetic tape unit, and/or a computer hard drive unit, and/or a digital sound storage device, and/or an audio CD unit that may include an optical disk. In one arrangement example, both a solid state memory and magnetic tape storage are utilized. In this example, the fixed portion of the message, e.g., "the baggage claim area is number_" is preferably stored on magnetic tape. To fill in the space at the end of the message, a synthesized message portion may be obtained, or generated, e.g., from the solid state memory, or in an alternate example, directly from the header data. The synthesized message portion is then immediately generated to give the number data, e.g., "2" that is utilized to fill in the space in the fixed portion of the message. Thus, a complete message may be then heard by the passengers.

In another arrangement, additional information data may be received, so as to be utilized to synthesize or generate an audio description output setting forth the relevant connecting flights, their destinations, flight numbers, and times and gates This audio output may also be combined with, e.g., the audio description of the arriving gate and baggage claim area for the present flight.

A terminal and gate description representing the destination, i.e., landing airport at which the aircraft is to land may also be retrieved from the memory device 390.

Either all, or a portion, of this extracted and retrieved information data may then be utilized, e.g., to further retrieve and assemble audio segments to describe the destination airport's physical layout, or to describe a suggested route for the passenger, upon exiting at the current flight's destination gate. The output audio signal containing the destination information may be described and repeated for a specified period of time.

If multiple descriptions of the terminal, connecting gates, layouts, and routes are provided, then the information may be cycled. The entire process may also be continually repeated and updated in approximate real time by the control unit 350.

Also, the audio information system 300 may alternatively or additionally provide in-flight information to the passengers. For example, the ground speed, outside air temperature, time to destination and altitude information may be obtained from the aircraft's navigation system and air data system. Again, the control unit 350 may process this input data and provide either a synthesized output, or select one or more audio segments in response to the data, or a combination of both, to generate the audio output.

In yet another arrangement, the passengers may also be provided with audio descriptions relating to the various phases of the flight. For example, these audio descriptions may describe the areas over which the aircraft is presently traveling, e.g., points of interest. Such point of interest messages may be triggered by the aircraft's navigation data so as to be timed to take place when the aircraft is near or over the point of interest. Thus, real-time audio information may be provided. These additional messages, or descriptions, may be either provided instead of, or incorporated with, the above audio outputs. Alternately, these additional descriptions may be provided on a separate channel, or only to selected passengers.

Examples of some various phases of the flight, and of information data associated with the various phases of the flight are more fully described in the above referenced U.S. Pat. Nos. 4,975,696 and 5,208,590. Analogous techniques and devices may be utilized to provide audio description output signals, as is described above for the information data and extraction techniques described below.

For example, the instant invention may provide a flight information audio description system for an aircraft passenger, wherein the aircraft follows a flight plan comprised of flight phases, and wherein the described information is tailored to the phases of the flight plan. Exemplary flight phases may include power on, preflight, engine start, taxi out, take-off, initial climb, climb, en route cruise, descent, approach/land, rollout, taxi in, go around, and engine shutdown. Any of the phases may also comprise a proximity to a point of interest.

The control unit 350 may utilize the received flight information to determine the current phase of the flight plan of the aircraft, i.e., the system determines whether the aircraft is in an "en route cruise" phase, or a "descent" phase, for example. Once the current phase of the flight plan has been determined, the control unit 350 generates one or more sequences of audio descriptions tailored to the current phase of the flight plan for delivery to a passenger of the aircraft.

For example, if the aircraft is in an "en route cruise" phase, the control unit 350 may generate a sequence of descriptions including a "ground speed and outside air temperature" description and a "flight plan" description, the latter describing the physical route of the aircraft. In another example, if the aircraft is in a "descent" phase, control unit 350 may generate a sequence of descriptions including a "time to destination" description and a "distance to destination" description.

For the different phases of the flight plan of the aircraft, different sequences of audio descriptions may be provided. Thus, the control unit 350 receives flight information, determines the current phase of the flight, and generates a sequence of descriptions corresponding to the current phase of the flight plan for presentation to the aircraft passenger.

The control unit 350 receives incoming messages from the flight systems of the aircraft and triggers a software interrupt as each message is received. The control unit 350 responds to each interrupt to retrieve the latest message, extract relevant flight information from the message, and update the current flight information block, thereby maintaining the latest flight information covering a wide variety of flight parameters.

Then, the control unit 350 accesses the entire flight information block from the memory device 390, and utilizes the information contained therein to determine the current phase of the flight plan of the aircraft, and then retrieves, from memory device 390, the audio description mode associated with that phase of the flight plan.

If a new phase of the flight plan has been reached, or if a currently provided description has been provided in excess of its time limit, the control unit 350 provides a new description. If the aircraft has not reached a new phase of the flight plan, and if the currently provided description has not been provided in excess of its time limit, the control unit 350 merely re-executes the providing step and continues to monitor the time limit until the time limit is exceeded, or until a software interrupt is received indicating that a new message has been received by the control unit 350.

When a software interrupt is received, the control unit 350 terminates whatever it is doing and then receives the new message. Alternatively, the new message may be reviewed as part of a background processing operation.

As previously indicated, the range table may include the location of a wide variety of points of interest, including cities, landforms, the equator, the International Date Line, and the North and South Poles.

The instant invention comprises an approximately real-time flight information audio description system for aircraft passengers. The system may provide useful audio information to the passengers en route to their destination. The system may utilize an existing aircraft present passenger audio delivery system. Such an audio system is particularly advantageous for use in smaller aircraft which do not have a video system installed. However, as seen below, in an alternate arrangement, the audio system of the instant invention may also be incorporated into larger aircraft that have an installed audio-video distribution system.

A description of the vehicle entertainment system 100 of this alternate arrangement is given below. Although an aircraft is described below, the system according to the invention may be implemented in any vehicle having a passenger entertainment system. Some of the examples include buses, boats, trains, and jetfoils.

Also, a description of some of the details of the vehicle entertainment system 100 have been omitted for clarity, and such details may be found in co-pending U.S. patent application Ser. No. 09/085,180, filed May 26, 1998, and assigned to the same assignee as the instant Application. This U.S. patent application Ser. No. 09/085,180 is entitled "Passenger Entertainment System, Method and Article of Manufacture Having Improved Area Distribution Equipment," and is incorporated by reference as though fully set forth herein.

FIG. 3 illustrates an operational environment depicting an exemplary vehicle entertainment system 100. The operational environment depicts a flight of an aircraft 111 employing the vehicle entertainment system 100. The vehicle entertainment system 100 is comprised of four main functional areas including head end equipment 200, area distribution equipment 210, seat group equipment 220, and overhead equipment 230. The head end equipment 200 provides an interface to external hardware and operators. The area distribution equipment 210 routes signals to and/or from the head end equipment 200, the seat group equipment 220, and the overhead equipment 230, depending upon the type of service provided to or requested by the passengers. The seat group equipment 220 contains a plurality of audio-video units (AVUs) 231. In each AVU 231, there is one to three seat controller cards (SCCs) 269. In FIG. 3, only one AVU 231 and one SCC 269 are illustrated for simplicity. One SCC 269 is provided to each passenger 117 seated in seat 123. The overhead equipment 230 includes video monitors and/or projectors and bulkhead screens or displays for displaying movies and other information. A headset 1122 is also generally provided.

A handheld or fixed passenger control unit 121 and a seatback screen display 122 (or seat display unit (SDU) 122)

are provided at each passenger seat 123 and permit the passengers 117 to interface to the system 100. The passenger control unit 121 is used to control downloading of movies for viewing, select audio channels for listening, initiate service calls to flight attendants, order products and services, and control lighting. The passenger control unit 121 is also used to control game programs that are downloaded and played at the passenger seat 123. If desired, the passenger control unit 121 may utilize carbon contacts in lieu of conventional membrane switches.

The instant airborne audio flight information system 300 may be connected to the head end equipment 200, so as to interface with the entertainment system as illustrated in FIG. 3. Alternatively, system 300 may form part of the head end equipment. The audio description signals may be provided along signal line 318 from the audio video unit 231 to the head set 1122, for utilization by a passenger.

It will be understood by one skilled in the art, that all of the alternate physical and logical arrangements, as described in relation to FIGS. 1–2, may be selectively applied, as desired, with the arrangements as described for FIG. 3, and vice versa.

It will thus be understood that the control unit 350 may receive information data that is specific to a flight characteristic of the aircraft. Such flight characteristics may include aircraft position, flight path, air speed, altitude, estimated time of arrival, landing gate and baggage claim information, or other information specific to, e.g., the flight's take-off, landing or route phases. The audio messages controlled by the control unit for delivery to the passengers may be responsive to one or more of the flight characteristics.

One example of a flight characteristic is aircraft position information. Aircraft position information may be provided by the navigation system, either directly through GPS-type data, or indirectly through time/speed/distance calculations. For example, the aircraft position information may be utilized to trigger pre-recorded, or pre-stored, audio messages relating to a point of interest that is located near the aircraft's current position. Thus, audio messages may be provided so as to be correlated in real-time to at least one aircraft characteristic—in this example, aircraft position.

In any of the above embodiments and arrangements, the passengers may be provided with audio advertising content. For example, before or after an audio description of a point of interest, an advertising clip or segment may be provided. The advertising clip may be provided by the airline, or by anyone. For example, when passing over a point of interest, an advertisement for a resort in the vicinity of the point of interest might be broadcast on the audio information system.

Also, transfer media may be utilized to load the audio advertising. The audio advertising may also include, for example, music. The audio advertising may also include parameters. The parameters may, e.g., be based upon or comprise flight segments or airports. The parameters may be utilized, e.g., to specify targeting frequency of advertising insertion, date validity of the advertising, and limits and counters on the number of times the advertising segment has been repeated. Tables may be kept of when the advertisement has been repeated, that may also control when it is next repeated. Further, the audio system may also store statistics on actual advertising insertions, and even user response to the advertising, in an alternate arrangement. The statistics may be down or off loaded, e.g., for billing or other desired purposes.

The invention has been described in reference to particular embodiments as set forth above. However, only the preferred embodiments of the present invention, and but a few examples of its versatility are shown and described in the present disclosure. It is to be understood that the present invention is capable of use in various other combinations and environments, and is capable of changes or modifications within the scope of the inventive concept as expressed herein. Also, many modifications and alternatives will become apparent to one of skill in the art without departing from the principles of the invention as defined by the appended claims.

What is claimed is:

1. An aircraft passenger audio information system connectable to receive information data specific to aircraft flight characteristics and connectable to an audio delivery system, the audio information system comprising:

a memory device for storing the information data that is input to the audio information system, a data control unit responsive to an aircraft flight characteristic for retrieving the information data from the memory device, and outputting the information data to the audio delivery system, wherein the information data comprises at least one of a point of interest and a proximity to a point of interest, and wherein the point of interest comprises at least one of a city along a flight path of the aircraft, a landform, an equator, an international dateline, a north pole and a south pole.

2. An aircraft passenger audio information system as recited in claim 1, wherein the memory device comprises at least one of a tape recorder, a solid state memory device, a computer hard drive, an optical disk, and a digital sound storage device.

3. An aircraft passenger audio information system as recited in claim 1, wherein the information data comprises at least one of:

a plurality of airport descriptions representative of a plurality of airports at which the aircraft may land, a flight number, and a landing airport at which the aircraft is to land.

4. An aircraft passenger audio information system as recited in claim 1, further comprising:

a receiver, for receiving at least a portion of the information data as an input from a remote transmitter, the remote transmitter comprising at least one of a ground, an airborne, and a space based transmitter, and wherein the receiver provides the information data as an output to at least one of the memory device and the data control unit.

5. An aircraft passenger audio information system as recited in claim 1, wherein the information data is not associated with video data.

6. An aircraft passenger audio information system as recited in claim 1, wherein at least a portion of the information data is processed into synthesized speech and is provided as an output to the audio delivery system.

7. An aircraft passenger audio information system as recited in claim 1, wherein the information data comprises a plurality of airport descriptions representative of the airports at which the aircraft may land, the information data further comprising at least one of a flight number and a landing airport at which the aircraft is to land, and wherein the data control unit utilizes at least one of the flight number and the landing airport information to retrieve an airport description of the landing airport from the memory device and outputs the airport description to the audio delivery system for utilization by a passenger.

8. The aircraft passenger audio information system as recited in claim 7, wherein information data further comprises at least one of a departure flight number, a departure time, a departure gate and a destination, and wherein the control unit outputs at least one of the departure flight number, the departure time, the departure gate, and the destination information to the audio delivery system for utilization by the passenger.

9. An aircraft passenger audio information system as recited in claim 7, wherein the information data further comprises baggage claim area information, and wherein the control unit outputs the baggage claim area information to the audio delivery system for utilization by the passenger.

10. An aircraft passenger audio information system as recited in claim 7, wherein the information data further comprises a plurality of aircraft arrival and departure gates, and wherein the data control unit generates a description signal, and outputs the description signal to the audio delivery system, wherein the description signal comprises an audio description of at least one of the landing airport and at least one of the aircraft arrival and departure gates.

11. An aircraft passenger audio information system as recited in claim 7, wherein the information data further comprises at least one of a terminal, a gate, and a baggage claim area for an arriving flight, and at least one of a terminal, a gate, a flight number, and a departure time for at least one relevant departing flight, that are located at the landing airport, the data control unit combining the airport description data retrieved from the memory device with at least a portion of the information data to generate an additional output to the audio delivery system for utilization by the passenger, wherein the additional output comprises a description, described with respect to the physical layout of the landing airport, of at least one of the terminal, the gate, and the baggage claim area for the arriving flight, and at least one of the terminal, the gate, the flight number, and the departure time of the at least one relevant departing flight.

12. The aircraft passenger audio information system as recited in claim 1, wherein the data control unit receives at lease a portion of the information data automatically from a remote communications link.

13. An aircraft passenger audio information system as recited in claim 12 wherein the remote communications link utilizes at least one of a ground, an airborne, and a spaced based transmitter.

14. The aircraft passenger audio information system as recited in claim 1, further comprising:

a data entry terminal wherein the data control unit receives as an input at least a portion of the information data from the data entry terminal, wherein the data entry terminal comprises at least a computer keyboard.

15. An audio information system for aircraft passengers, in an aircraft following a flight plan, the audio information system comprising:

a receiver for receiving flight information data;

a memory device for storing a plurality of audio formats for describing flight information, and for storing a plurality of audio modes, each mode representing a specific sequence of preselected audio formats, with each audio mode corresponding to one phase of the flight plan of the aircraft, a data control unit for determining a current phase of the flight plan, wherein the data control unit also retrieves a sequence of audio formats for an audio mode corresponding to a determined current phase of flight, and wherein the data control unit inserts the received flight information data into the retrieved audio formats and outputs the retrieved sequence of audio formats to an audio delivery system, and further wherein system, and further wherein the memory device stores, for at least one phase of the flight plan, a plurality of ranges of flight information, and the data control unit determines the current phase of the flight plan by a method comprising the steps of:

comparing the received flight information data with the plurality of ranges of flight information data stored by the memory device, determining, out of the plurality of ranges, a current range corresponding to the received flight information data, and identifying the current phase of the flight plan as being the phase corresponding to the current range.

16. The aircraft passenger audio information system as recited in claim 15, wherein the current phases of flight comprise at least one of a taxi out, a take off, an initial climb, a climb, an en route cruise, a proximity to a point of interest, a descent, an approach, a landing, a rollout, and a taxi in.

17. The aircraft passenger audio information system as recited in claim 15, wherein the flight information data comprises at least one of a ground speed, an altitude, a time from departure airport, a distance from departure airport, a time to destination airport, and a distance to destination airport.

18. An audio information system for aircraft passengers, in an aircraft following a flight plan, the audio information system comprising:

a receiver for receiving flight information data;

a memory device for storing a plurality of audio formats for describing flight information, and for storing a plurality of audio modes, each mode representing a specific sequence of preselected audio formats, with each audio mode corresponding to one phase of the flight plan of the aircraft, a data control unit for determining a current phase of the flight plan, wherein the data control unit also retrieves a sequence of audio formats for an audio mode corresponding to a determined current phase of flight, and wherein the data control unit inserts the received flight information data into the retrieved audio formats and outputs the retrieved sequence of audio formats to an audio delivery system, and wherein the current phases of flight comprise at least one of a taxi out, a take off, an initial climb, a climb, an en route cruise, a proximity to a point of interest, a descent, an approach, a landing, a rollout, and a taxi in, and further wherein the point of interest comprises at least one of a city along a flight path of the aircraft, a landform, an equator, an international dateline, a north pole and a south pole.

19. The aircraft passenger audio information system as recited in claim 18, wherein the memory device stores, for at least one phase of the flight plan, a plurality of ranges of flight information, and the data control unit determines the current phase of the flight plan by a method comprising the steps of:

comparing the received flight information data with the plurality of ranges of flight information data stored by the memory device, determining, out of the plurality of ranges, a current range corresponding to the received flight information data, and identifying the current phase of the flight plan as being the phase corresponding to the current range.

20. A method of providing audio information to an aircraft passenger in an aircraft comprising the steps of:

storing information data corresponding to an audio description of at least one of (1) a point of interest, (2) aircraft flight parameters and (3) information associated with a destination airport, automatically retrieving the stored information data, and automatically outputting the retrieved information data to an audio delivery system, wherein the output information data further comprises at least one of:

a distance to the point of interest, a flight altitude, an outside temperature, a ground speed, an airspeed, and a plurality of relevant connecting flight information at a destination airport.

21. A method of providing audio information to an aircraft passenger as recited in claim 20, wherein the output information data further comprises at least one of:

a plurality of data describing airport descriptions representative of a plurality of airports at which the aircraft may land, a flight number of the aircraft, an airport at which the aircraft is to land, and a plurality of at least one of a departure flight number, a departure time, a departure gate and a departure destination.

22. A method of providing audio information to an aircraft passenger as recited in claim 20, further comprising the step of:

receiving the information data from a remote transmitter, the remote transmitter comprising at least one of a ground, an airborne, and a space based remote transmitter.

23. An aircraft passenger audio information system connectable to receive information data specific to aircraft flight characteristics and connectable to an audio delivery system, the audio information system comprising:

a memory device for storing the information data that is input to the audio information system, a data control unit responsive to an aircraft flight characteristic for retrieving the information data from the memory device, and outputting the information data to the audio delivery system, wherein the information data comprises a plurality of airport descriptions representative of the airports at which the aircraft may land, the information data further comprising at least one of a flight number and a landing airport at which the aircraft is to land, and wherein the data control unit utilizes at least one of the flight number and the landing airport information to retrieve an airport description of the landing airport from the memory device and outputs the airport description to the audio delivery system for utilization by a passenger, wherein the information data further comprises at least one of a terminal, a gate, and a baggage claim area for an arriving flight, and at least one of a terminal, a gate, a flight number, and a departure time for at least one relevant departing flight, that are located at the landing airport, the data control unit combining the airport description data retrieved from the memory device with at least a portion of the information data to generate an additional output to the audio delivery system for utilization by the passenger, and further wherein the additional output comprises a description, described with respect to the physical layout of the landing airport, of at least one of the terminal, the gate, and the baggage claim area for the arriving flight, and at least one of the terminal, the gate, the flight number, and the departure time of the at least one relevant departing flight.

* * * * *